US008915420B2

(12) United States Patent
Masague

(10) Patent No.: US 8,915,420 B2
(45) Date of Patent: Dec. 23, 2014

(54) WARDROBE BOX

(71) Applicant: Embalajes Caspa, S.L., Canet de Mar (ES)

(72) Inventor: Manuel Lopez Masague, Arenys de Mar (ES)

(73) Assignee: Embalajes Capsa, S.L., Canet de Mar (ES)

( * ) Notice: Subject to any disclaimer, the term of this patent is extended or adjusted under 35 U.S.C. 154(b) by 119 days.

(21) Appl. No.: 13/667,342

(22) Filed: Nov. 2, 2012

(65) Prior Publication Data

US 2013/0056529 A1 Mar. 7, 2013

Related U.S. Application Data

(63) Continuation of application No. 12/600,081, filed as application No. PCT/IB2008/051903 on May 14, 2008, now abandoned.

(30) Foreign Application Priority Data

May 14, 2007 (ES) ..... 200701358

(51) Int. Cl.
*B65D 5/10* (2006.01)
*B65D 85/18* (2006.01)
*B65D 5/16* (2006.01)

(52) U.S. Cl.
CPC ..... *B65D 5/10* (2013.01); *B65D 85/185* (2013.01); *B65D 2313/02* (2013.01); *B65D 5/16* (2013.01)
USPC ..... 229/126; 220/254.6

(58) Field of Classification Search
CPC .... B65D 75/14; B65D 5/2057; B65D 5/2052; B65D 5/4254; B65D 5/0227; B65D 5/106; B65D 5/103; B65D 5/10; B31B 1/62
USPC ..... 220/254.6, 254.3, 810, 254.2, 254.1, 220/212; 229/103.3, 103, 117.13, 117.12, 229/122, 138, 127, 126, 124; 206/299, 298
See application file for complete search history.

(56) References Cited

U.S. PATENT DOCUMENTS 1,566,196 A * 12/1925 Garcia ..... 229/102
2,974,779 A * 3/1961 Belsinger ..... 206/279
3,750,933 A * 8/1973 Nicolay ..... 229/240
4,013,213 A 3/1977 Giebel (Continued)

FOREIGN PATENT DOCUMENTS

GB 700741 3/1953

OTHER PUBLICATIONS

U.S. Appl. No. 12/600,081, filed Dec. 11, 2009. Office Action mailed Jun. 8, 2012.

(Continued)

*Primary Examiner* — Robert J Hicks
(74) *Attorney, Agent, or Firm* — Lawrence G. Fridman

(57) ABSTRACT

The wardrobe box is formed with a lid, a bottom and side walls. A door is provided at one of the sidewalls. The lid comprises two hinge sectors engageable to each other. The hinge sectors of the lid comprise complimentary flaps engageable to each other, whereas the door is formed with a detachable closing element. Such structure requires no additional elements to close the lid and to keep the door closed.

10 Claims, 3 Drawing Sheets

(56) References Cited

U.S. PATENT DOCUMENTS

| | | | | |
|---|---|---|---|---|
| 5,184,772 | A * | 2/1993 | McGrath | 229/143 |
| 2005/0011938 | A1 | 1/2005 | West | |
| 2007/0138245 | A1 * | 6/2007 | Mittelstaedt et al. | 229/163 |
| 2010/0308067 | A1 | 12/2010 | Lopez Masague | |

OTHER PUBLICATIONS

U.S. Appl. No. 12/600,081, filed Dec. 11, 2009. Office Action mailed Dec. 5, 2011.

* cited by examiner

WARDROBE BOX

This application is a continuation of the currently pending U.S. application Ser. No. 12/600,081, Filed: Dec. 11, 2009, which claims the priority of PCT Application No. PCT/IB2008/051903 filed May 14, 2008, the entire disclosure of which is herein incorporated by reference; which in turn claims priority of Spanish Patent Application P-200701358 filed May 14, 2007.

The present invention refers to a wardrobe box, specially designed to contain and transport clothes hung from hangers.

BACKGROUND OF THE INVENTION

The wardrobe boxes are used to contain and transport clothes hung from hungers. To this end, the wardrobe boxes comprise a transversal bar, from which the hangers hung. This transversal bar is usually engaged on the upper edge of the wardrobe box.

To place or remove the clothes, the wardrobe box comprises an upper lid. Usually, to transport the wardrobe box the upper lid must be closed by a closing element, e.g. adhesive tape.

To place and remove the clothes, the known wardrobe boxes comprise a door at one of its side walls.

Furthermore, to facilitate the transportation of the wardrobe box, it comprises handle-like holes in two opposed side walls of the wardrobe box.

The known wardrobe boxes have several drawbacks. Firstly, to close the door of the wardrobe box it is necessary to place the closing element on the lid, because if it is not closed, the lid can be opened. The placement of the closing element each time the lid is closed is uncomfortable, and when the closing element is removed the lid can be damaged, so that the wardrobe box cannot be used several times.

SUMMARY OF THE INVENTION

With the wardrobe box of the invention said drawbacks can be solved, presenting other advantages that will be described.

The wardrobe box of the present invention comprises a lid, a bottom and side walls, and it is characterised in that said lid comprises two hinged sectors engageable to each other.

Therefore, it is not necessary to use an additional closing element, such as e.g. adhesive tape, to close the lid and to keep the door closed, unlike the known wardrobe boxes. Furthermore, it permits to use less material than the conventional wardrobe boxes.

Advantageously, said sectors of the lid comprise complementary flaps engageable to each other.

Preferably, the door of the wardrobe box of the present invention comprises a detachable closure, that according to a preferred embodiment, is made from Velcro®, i.e. is formed by the bands engageable to each other, one provided with a plurality of hooks and the other one provided with a velvet material, one of the bands being placed on said door and the other one on the adjacent side wall against which the door closes.

With respect to the bottom of the wardrobe box of the present invention, it comprises formed flaps engageable to each other.

BRIEF DESCRIPTION OF THE DRAWINGS

For a better understanding of what has been described some drawings are attached in which, diagrammatically and only as a non-limitative example, a practical case of embodiment is shown.

DESCRIPTION OF A PREFERRED EMBODIMENT

As it can be seen in the figures, the wardrobe box of the present invention comprises a lid 1, a bottom 2 and four side walls 3, one of said side walls 3 being provided with a door 4.

Figure 1:
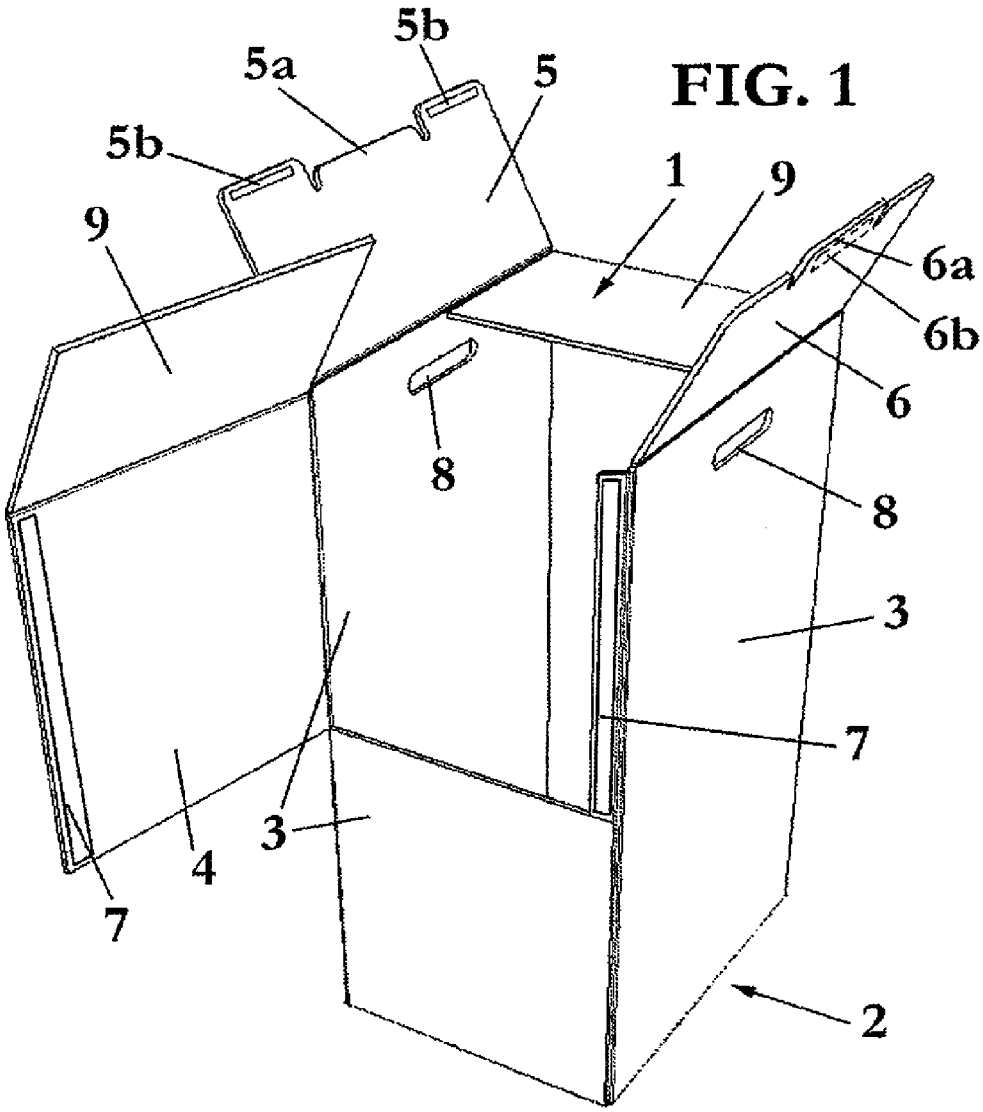
FIG. 1 is a perspective view of the wardrobe box of the present invention with its lid and its door opened.
Figure 2:
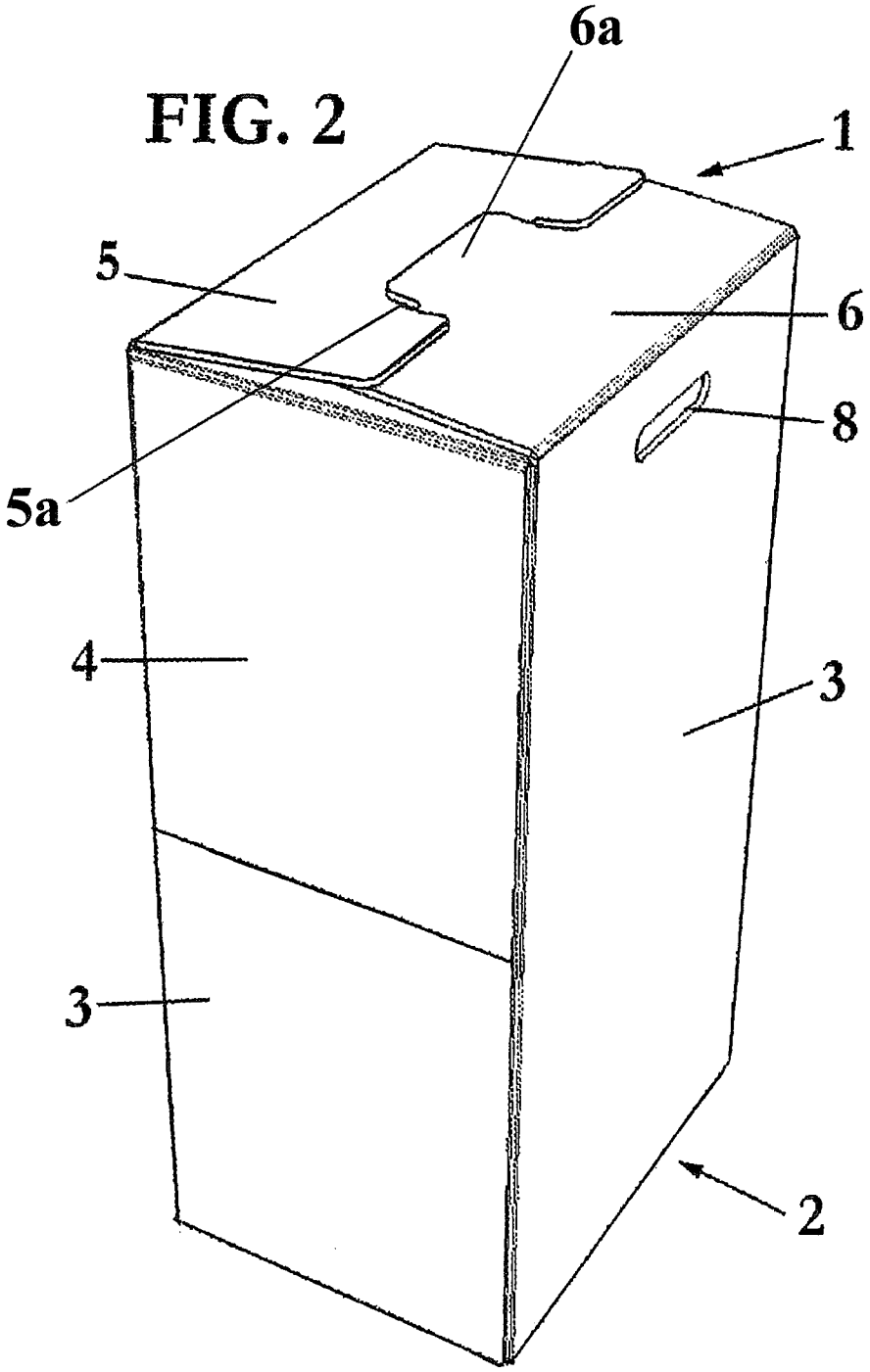
FIG. 2 is a perspective view of the wardrobe box of the present invention closed.
Figure 3:
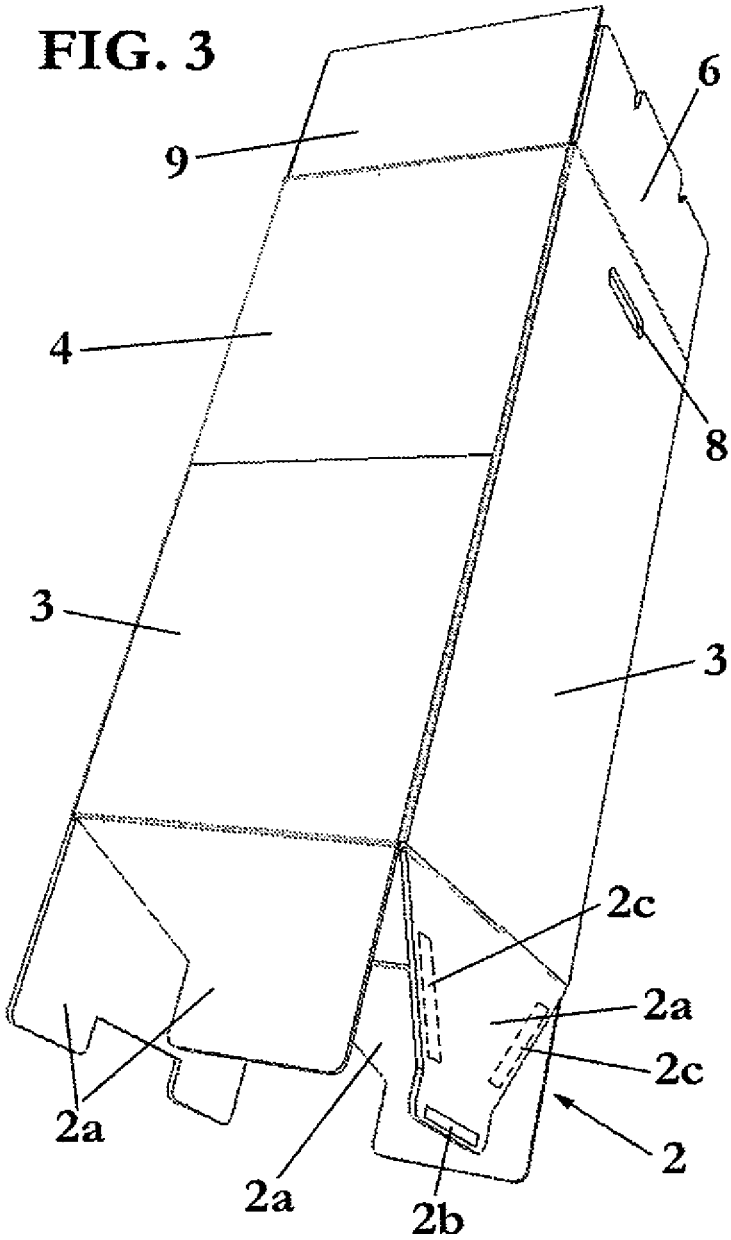
FIG. 3 is a perspective view of the wardrobe box of the present invention with its lid and its bottom opened.

The lid 1 comprises two hinged sectors 5 and 6 engageble to each other by flaps 5*a* and 6*a* provided in these sectors. It is illustrated in FIGS. 1-3 that in the sector 5, the first flap 5*a* is disposed between two side regions 5, so as to extend inwardly to form a recess. In the sector 6, a second flap 6*a* is positioned between two side regions, extending outwardly therefrom to form a projection. It is also shown in FIG. 1, that the first flap 5*a* is formed with a pair of spaced grooves extending inwardly from a level of the recess. The second flap 6*a* is formed with a pair of spaced grooves extending inwardly from a level of the side regions. It is shown in FIG. 2 that in a closed condition of the wardrobe box, the outwardly extending projection of the second flap 6*a* engages/received within/positioned over the inwardly extending recess of the first flap 5*a*.

These hinged sectors 5, 6 permit to close the lid 1 with no external closing element, such as e.g. adhesive tape.

The lid 1 can also comprise a pair of additional flaps 9 to reinforce it, that are folded below said hinged sectors 5, 6.

Furthermore, the lid 1 comprises adhesives 5*b*, 6*b* to keep said hinged sectors 5, 6 joined to each other. Preferably, said adhesives 5*b*, 6*b* are double-sided adhesives tapes.

When the lid 1 is closed, the door 4 is also closed, which means that the door 4 can be closed also with no external closing element.

The door 4 also comprises a detachable closing element 7, made up from two complementary bands of Velcro® or adhesive, one placed in the door 4 and the other one placed on the adjacent side wall 3.

This detachable Velcro® closing element or adhesive permits to open and close the door 4 any times not damaging the wardrobe box of the present invention.

Two opposed side walls 3 comprise holes 8 provided to house the ends of a transversal bar (not shown) to hang the hangers for cloths that will be placed inside the wardrobe box of the present invention.

This transversal bar is the same that is disclosed in the Spanish utility model U9500827, which is included here as reference, whose inventor is the same than the inventor of this application.

The use of this transversal bar permits to provide handles at their ends, and it permits at the same time to close completely the wardrobe box, preventing the entrance of dust.

The bottom 2 of the wardrobe box of the present invention is made up from flaps 2*a* engageable to each other, as it can be seen from FIG. 3.

Said bottom 2 also comprises adhesives 2*b*, 2*c* that join the flaps 2*a* to each other. Preferably, said adhesives 2*b*, 2*c* are double-sided tapes.

Even though reference is made to a specific embodiment of the invention, it is apparent for a person skilled in the art that the described wardrobe box is susceptible of numerous variations and modifications, and that all the details cited can be substituted by other technically equivalent ones, without departing from the scope of protection defined by the attached claims.

The invention claimed is:

1. A wardrobe box, comprising:

a lid, a bottom and side walls, an opening defined between a first side wall and a second side wall, and a door pivotably coupled to at least one of the first and second side walls, the door being configured to cover the opening, (i) the lid comprises a first hinged sector and a second hinged sector capable of engaging the first hinged sector, (ii) the first hinged sector is pivotably coupled to the first side wall and includes a first flap, and (iii) the second hinged sector is pivotably coupled to the second side wall and includes a second flap capable of engaging the first flap;

the first flap is formed with a central region disposed between two side regions, the central region of the first sector extends inwardly from a level of said side regions to form a recess, the second flap is formed with a central region disposed between two side regions, the central region of the second sector extends outwardly from a level of the side regions to form a projection;

the first flap is formed with a pair of spaced from each other engaging grooves, said engaging grooves extending inwardly from the recess; and the second flap is formed with a pair of spaced from each other engaging grooves extending inwardly from the side regions;

wherein in a closed condition of the wardrobe box said projection of the second flap is received within said recess of the first flap.

2. The wardrobe box according to claim 1, wherein said door comprises a detachable closing element.

3. The wardrobe box according to claim 2, wherein the detachable closing element of the door comprises two bands engageable to each other, one said band is provided with a velvet material, wherein one of the bands being placed on said door and the other band is placed at one of the adjacent side wall against which said door is closed.

4. The wardrobe box according to claim 1, wherein said bottom comprises four flaps engaging each other.

5. The wardrobe box according to claim 1, wherein the first hinged sector and the second hinged sector are movable between (i) a first position in which the first flap and the second flap are engaged in such a manner that the second flap is positioned over the first flap, and (ii) a second position in which the first flap and the second flap are spaced apart from each other.

6. The wardrobe box according to claim 1, wherein the side regions of the first flap are positioned over the side regions of the second flap when first flap engages the second flap.

7. The wardrobe box according to claim 1, wherein said side regions of the first flap are provided with adhesive, said adhesive is adjacent to the respective engaging grooves, so as to reinforce closing of the lid and prevent accidental box opening.

8. The wardrobe box according to claim 1, wherein said projection of the second flap is provided with adhesive, so as to reinforce the lid closing and prevent accidental opening of the box.

9. The wardrobe box according to claim 7, wherein said adhesive is symmetrical with respect to central region of the first flap.

10. The wardrobe box according to claim 1, further comprising a first and second additional flaps provided to reinforce said lid, said first additional flap is pivotably connected to said door and said second additional flap is pivotably connected to the sidewall adapted to accommodate said door, wherein in an assembled of a wardrobe box said first and second additional flaps are disposed below said first and second flaps engaging each other.

* * * * *